US005487483A

United States Patent [19]

Kubby

[11] Patent Number: 5,487,483

[45] Date of Patent: Jan. 30, 1996

[54] NOZZLES FOR INK JET DEVICES AND METHOD FOR MICROFABRICATION OF THE NOZZLES

[75] Inventor: Joel A. Kubby, Rochester, N.Y.

[73] Assignee: Xerox Corporation, Stamford, Conn.

[21] Appl. No.: 248,047

[22] Filed: May 24, 1994

[51] Int. Cl.[6] ..... B44C 1/22

[52] U.S. Cl. ..... 216/27; 216/2; 347/47

[58] Field of Search ..... 216/27, 2, 39, 216/57, 66, 79; 156/647.1; 204/192.34; 347/47

[56] References Cited

U.S. PATENT DOCUMENTS

| | | | |
|---|---|---|---|
| 4,106,976 | 8/1978 | Chiou et al. | 216/27 |
| 4,157,935 | 6/1979 | Solyst | 216/27 |
| 4,169,008 | 9/1979 | Kurth | 216/27 |
| 4,413,268 | 11/1983 | Bentin | 346/1.1 |
| 4,455,192 | 6/1984 | Tamai | 216/27 |
| 4,475,113 | 10/1984 | Lee et al. | 346/1.1 |
| 4,808,260 | 2/1989 | Sickafus et al. | 156/647.1 |
| 4,863,560 | 9/1989 | Hawkins | 216/27 |
| 4,875,968 | 10/1989 | O'Neill et al. | 216/27 |
| 4,961,821 | 10/1990 | Drake et al. | 156/647.1 |
| 5,041,190 | 8/1991 | Drake et al. | 216/39 |
| 5,277,755 | 1/1994 | O'Neill | 216/27 |

FOREIGN PATENT DOCUMENTS

| | | | |
|---|---|---|---|
| 58-112755 | 7/1983 | Japan | 347/47 |

OTHER PUBLICATIONS

"Ink Jet Printing," M. Doring, Philips Tech. Review, Rev. 40, 192 (1982).

*Primary Examiner*—R. Bruce Breneman
*Assistant Examiner*—Alanko: Anita
*Attorney, Agent, or Firm*—Oliff & Berridge

[57] ABSTRACT

An ink jet nozzle reduces wetting problems around the ink jetting orifice by providing a hollowed annular, polygonal or n-sided extension lip having sharp angles to prevent ink from settling in the regions surrounding the orifice of the ink jet nozzle. The ink jet nozzle is microfabricated by a two step process including a first step of exposing a (100) silicon wafer having a throughhole and a (100) crystallographic plane or other low index plane to physical sputter erosion, e.g., a plurality of parallel radiating ion beams thus creating a facet that eventually enlarges into a plurality of (111) crystallographic planes or other high index planes. The second step includes an anisotropic chemical etch of the nozzle body using an orientation dependent etching (ODE) technique in which the (100) crystallographic plane is etched at a rate of 35 to 400 times higher than the (111) crystallographic planes. While (100) and (111) crystallographic planes are the preferred embodiments, other pairs of crystallographic planes will also work. The resulting structure includes a (111) oriented lip surrounding the orifice. During the step of anisotropic etching, the (111) crystallographic planes act as a mask to prevent the chemical from etching the (111) plane.

34 Claims, 5 Drawing Sheets

NOZZLES FOR INK JET DEVICES AND METHOD FOR MICROFABRICATION OF THE NOZZLES

BACKGROUND OF THE INVENTION

1. Field of the Invention

This invention relates to anti-wetting ink jet nozzles and a method of precisely forming anti-wetting ink jet nozzles in single crystal silicon wafers or other single crystal semiconductor materials such as germanium or gallium arsenide. The method comprises a two-step process including a first step of physical sputter erosion, e.g., ion beam radiating of a front face of the ink jet nozzle to expose high index crystallographic planes around an ink jet nozzle orifice having an annular, polygonal or n-sided shape. The second step involves an anisotropic chemical etch that etches the front face of the wafer at a rate of 35 to 400 times that of the high index planes, which leaves behind a lip surrounding the orifice. The wafer subunits are then aligned in extended arrays to form, for example, page width printheads for ink jet type printers.

2. Description of Related Art

FIG. 1A shows a prior art ink jet printing device 1 having a conventional nozzle structure that includes an annular bore 3 and a front face 4 that is oriented perpendicular to the axis of the bore 3. Each bore 3 of an ink jetting device 1 is supplied with a supply of ink 2 that is intended to create characters on a recording medium (not shown). FIG. 1A shows the progression of ink 2 as it emerges from the bore 3 and eventually onto a recording medium. The formation of a droplet 5 eventually occurs at the mouth of the bore and gradually builds in size until the ink emerges from the bore and prints the desired character on the recording medium. Thermal ink jet devices of this type suffer in print quality when wetting 6 occurs on the front face 4 of the ink jet nozzle. This type of wetting creates imprecise character printing and often times smudging.

In addition, when a portion 7 of the ink 2 surrounding the orifice 3 dries in an asymmetrical manner as shown in FIG. 1B, a next forming droplet 8 is cohesively attracted to the side where the wetting is greatest and deflected in that direction as indicated by arrow 9. Prior art thermal ink jet devices use a hydrophobic front face coating to minimize front face wetting by the ink in an attempt to avoid these directionality problems.

Another solution is to minimize wetting by microfabricating a nozzle structure surrounding the orifice that minimizes front face wetting. Such a solution to the ink wetting problem is shown in prior art FIG. 2 which shows an ink jet nozzle 10 having a front face 11 perpendicular to a bore 12 forming a passage for ink 13 to be supplied from an unshown source. In addition, the nozzle 10 of FIG. 2 includes a lip portion 14 that serves to prevent wetting on the front face 11 of the nozzle. While this nozzle structure helps to eliminate wetting, it suffers because it is currently manufactured by expensive chemical or mechanical processes.

FIG. 3 shows a five-step chemical process by which a lip portion of the prior art device of FIG. 2 is formed. The first step is to provide a brass plate 15 as shown in step (a) and to drill a first cylindrical hole 16 and a second countersunk bore 17 within the brass plate 15 (step (b). In step (c), a layer of nickel 18 is applied by the "electroless" method to all surfaces of brass plate 15 of step (b) including top face 19, bottom face 20, and the surfaces of throughhole 16 and countersunk hole 17. In step (d), the bottom surface 21 of the nickel layer 18 and some of the brass, where necessary, are removed by grinding. Finally, in step (e), the surface 20' surrounding the nickel surface 18*b* coated onto annular bore 16 is selectively etched to produce a lip portion 14 of the nozzle.

FIGS. 4A and 4B show an alternative method for mechanically forming a lip portion on an ink jet nozzle. In this process, the object is to punch a hole using punch 22 in a nickel plate 23, the nickel plate forming the nozzle. A force F drives the punch 22 into the nickel plate 23. At the end of the process, a part of the nickel plate 23 will penetrate into a plastic strip 24. Because of the supporting action of steel plate 25 and the fluid behavior of plastic 24, a hole 26 without burrs and of the desired shape including a lip 27 is produced in the nickel plate 23.

U.S. Pat. No. 4,961,821 to Drake et al. discloses a method for forming throughholes in silicon wafers using an orientation dependent etching technique, and is incorporated herein by reference. As shown in FIGS. 9E and 9F of Drake, however, the ink jet nozzles encounter the same problems as those discussed in reference to FIGS. 1A and 1B. Moreover, the orifices of Drake do not provide for a lip portion that prevents wetting around the area surrounding the ink jetting orifice. In addition, the method for manufacturing the orifice includes an anisotropic method of etching that requires surfaces 31 and 32 to be covered with an etch resistant layer 34 in those areas where it is not desired to form a throughhole. Moreover, Drake anisotropically etches (100) crystallographic planes 35 and 36 using an additional etch resistant layer 34 to mask those portions of the wafer 30 not desired to be etched.

SUMMARY OF THE INVENTION

It is an object of the present invention to provide an anti-wetting ink jet nozzle for a printing device that prevents unwanted deflection of ink droplets by preventing asymmetrical depositing of ink about the regions surrounding the orifice of the ink jet nozzle.

It is another object of the present invention to form precision ink jetting nozzles in single crystal silicon wafers or other semiconductor materials such as germanium or gallium arsenide by a two-step process including physical sputter erosion of the front face of the ink device, and chemically etching the nozzle area surrounding the orifice using an anisotropic etching method.

It is another object to form the nozzles of the ink jetting devices in a cost-efficient and time-efficient manner.

The present invention makes use of a nozzle structure including a hollow extension lip portion formed as a part of the nozzle body that prevents wetting of the front face of the nozzle body during the ink dispensing process. The hollow extension lip comprises an annular pyramidal, polygonal or n-sided wall member having an outer perimeter surface and an inner perimeter surface, the inner and the outer perimeter surfaces being connected by an angled connection portion in the form of a truncated section, for example, a truncated pyramidal or conical section.

According to the method for microfabricating the nozzle structure of the present invention, a (100) silicon wafer or another suitable crystalline orientation is first provided having a throughhole bored therein of predetermined dimensions. The nozzle body includes a (100) crystallographic plane or other suitable crystalline orientation that is first subjected to ion beam radiation to erode a facet in the inner section of the annular bore and the front plane at a predetermined angle to create a plurality of (111) crystallographic planes or other slow etching planes. After application of the ion beam radiation, the nozzle structure includes the nozzle body having a countersunk orifice. Starting with the countersunk orifice, the fast etching or (100) crystallographic plane as well as the slow etching countersunk orifice are equally exposed to an anisotropic chemical etchant that etches the fast etching or (100) crystallographic plane at a first rate and the slow etching or (111) crystallographic planes of the countersunk orifice at a second rate that is 35–400 times lower than the first rate. The disparity in etching rates causes the (100) crystallographic plane to define a sharp lip portion that prevents wetting in the region surrounding the countersunk orifice.

BRIEF DESCRIPTION OF THE DRAWINGS

A preferred embodiment of the invention will be described in detail with reference to the following drawings in which like reference numerals refer to like elements, and wherein.

DETAILED DESCRIPTION OF PREFERRED EMBODIMENTS

The present invention involves an ink nozzle device including a (100) single crystal silicon wafer or other suitable semiconductor materials such as germanium or gallium arsenide that includes a (100) or another suitable crystalline orientation crystallographic plane, a through bore, and an ink wetting prevention lip in the form of a sharply angled hollow lip portion having an annular or pyramidal shape that extends from the (100) crystallographic plane. The present invention also involves a process for microfabricating the hollow lip portion in the nozzle body in which a nozzle body having a throughhole having an annular, polygonal or n-sided shape is first provided and then exposed to ion beam radiation to form a facet that is substantially impervious to a second step of anisotropically chemically etching the (100) crystallographic plane of the nozzle body.

Figure 1A:
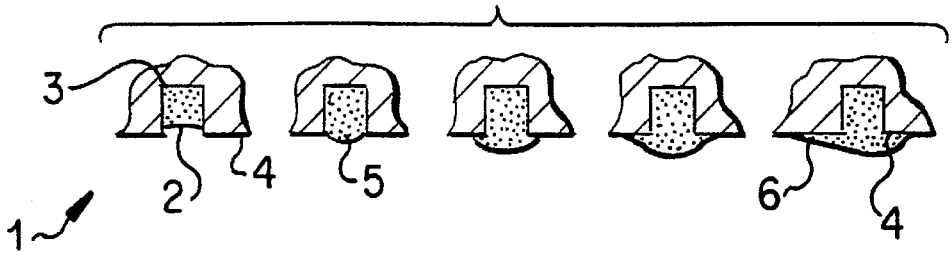
FIG. 1A PRIOR ART
FIGS. 1A and 1B show a prior art nozzle that suffers from wetting in the region of the orifice.
Figure 1B:
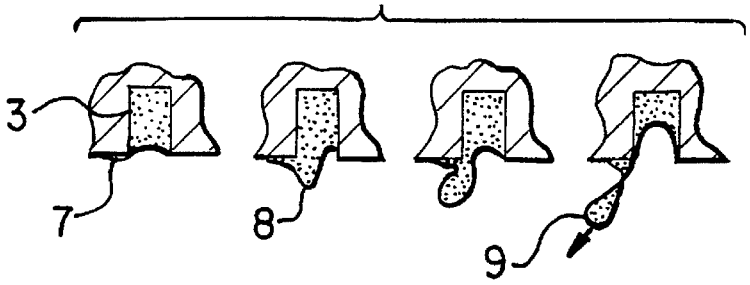
FIG. 1B PRIOR ART
Figure 2:
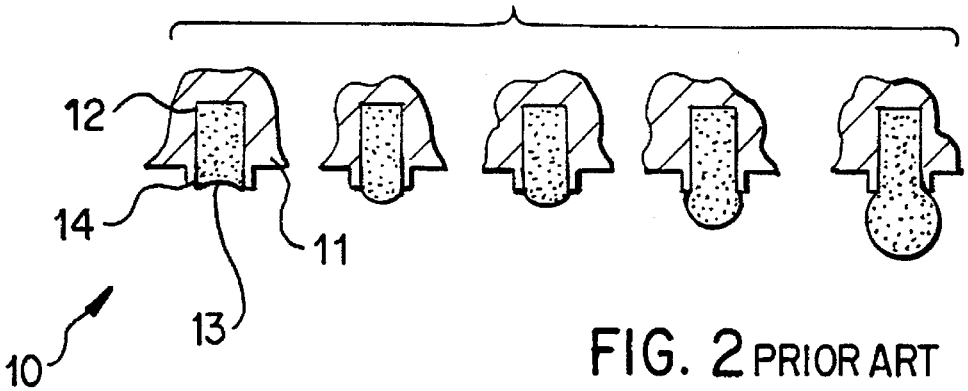
FIG. 2 PRIOR ART
FIG. 2 shows a prior art nozzle having a cylindrical lip portion.
Figure 3:
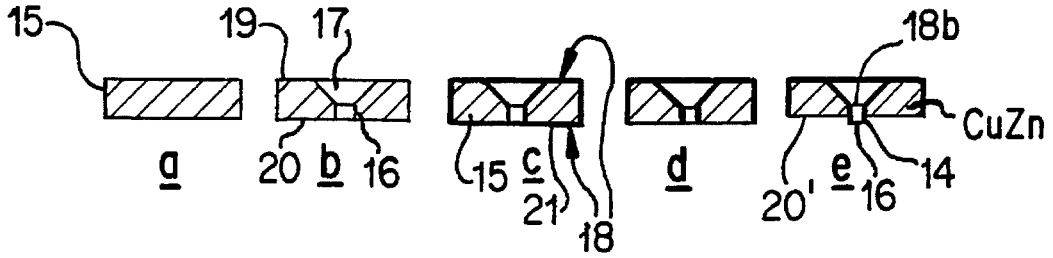
FIG. 3 PRIOR ART
FIG. 3 shows a prior art chemical method of forming a lip portion of FIG. 2.
Figure 4A:
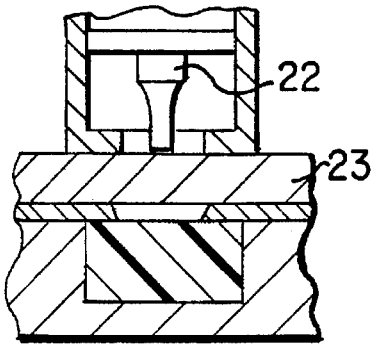
FIG. 4A PRIOR ART
FIGS. 4A and 4B show a mechanical process for forming a lip portion in a nickel plate nozzle.
Figure 4B:
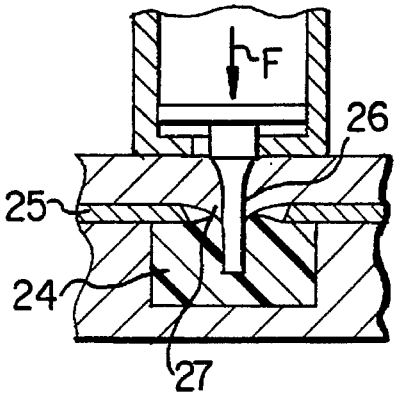
FIG. 4B PRIOR ART
Figure 5A:
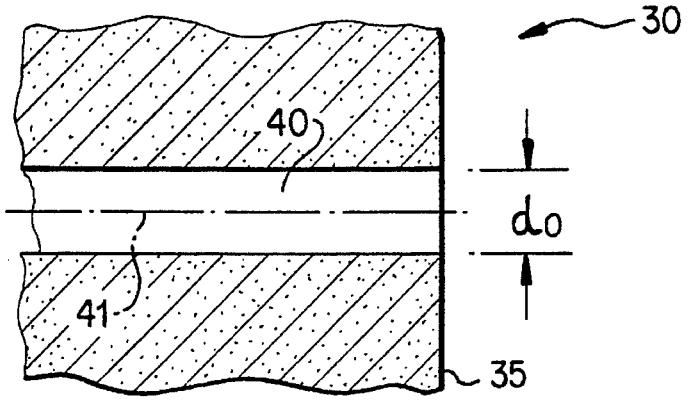
FIGS. 5A–5E show an embodiment of the present invention.
Figure 5B:
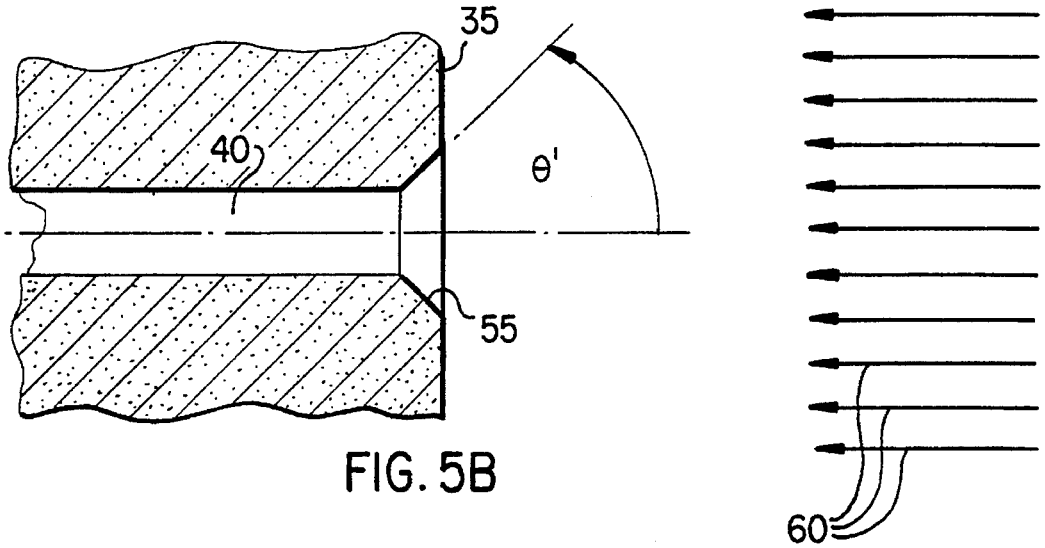
Figure 5C:
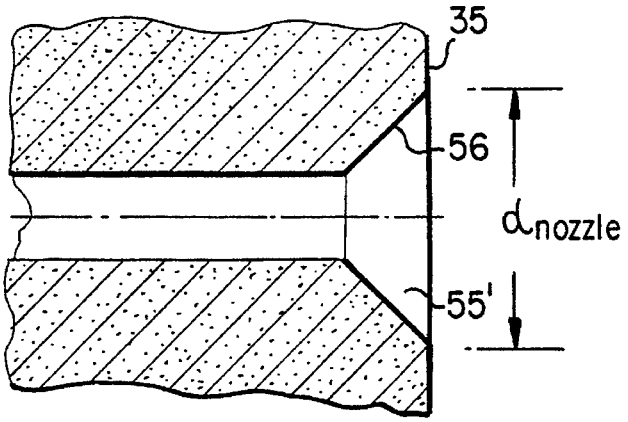
Figure 5D:
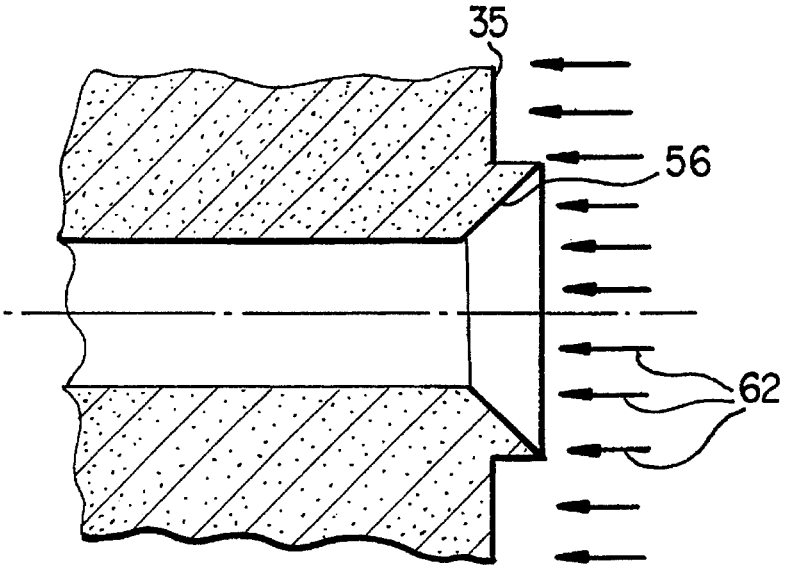
Figure 5E:
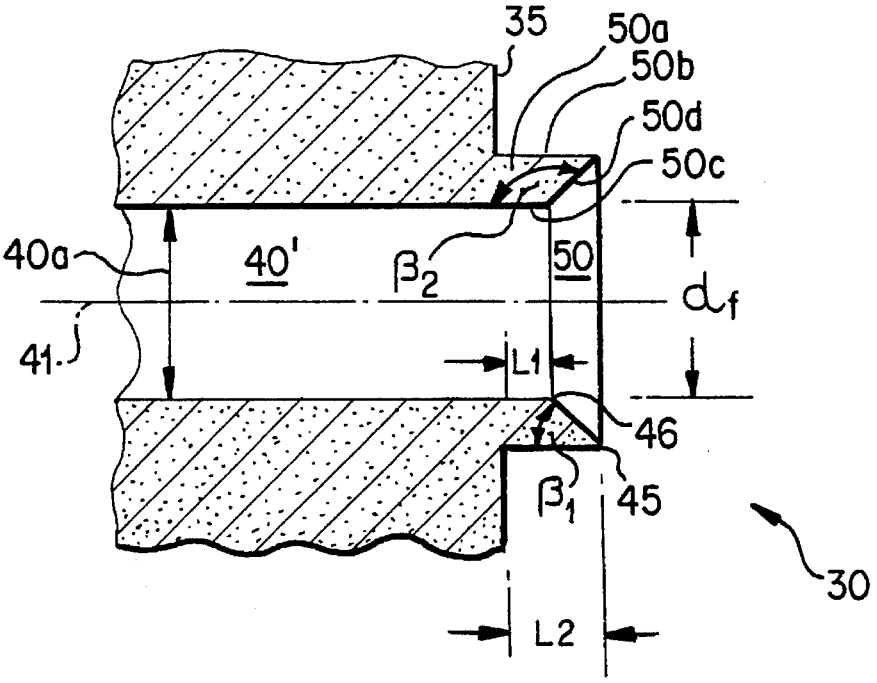

As illustrated in FIG. 5E, a (100) wafer 30, preferably of silicon, includes a (100) crystallographic first plane 35 defined in terms of monocrystalline silicon electrophysical geometry as a plane parallel to surfaces of the parallelpiped structure of the crystal. The nozzle body also includes a bore 40 including an axis 41 that is perpendicular to the (100) crystallographic plane 35. The ink jet nozzle 30 also includes a hollow extension lip 50 that includes a thin wall member 50*a* of predetermined dimensions having an outer diameter surface 50*b* and an inner diameter surface 50*c*. The inner diameter surface includes a first axial length L1 and the outer diameter surface 50*b* has a corresponding second axial length L2 that is greater than the first axial length L1. The nozzle body also includes an angled connection portion 50*d* that connects the inner diameter surface 50*c* to the outer diameter surface 50*b*. The angled connection portion 50*d* comprises a (111) crystallographic plane and is in the form of a truncated conical, pyramidal or n-sided section. An intersection 45 between the outer diameter surface 50*b* and the connection portion 50*d* defines an acute angle β1. A second intersection 46 is defined by the intersection of inner diameter surface 50*c* and connecting portion 50*d* and defines an obtuse angle β2. The inner diameter surface 50*c* extends axially beyond the first plane 35 and has a diameter coincident with the diameter 40*a* of annular bore 40.

With such a construction, the ink wetting problems of the prior art can be solved. More specifically, hollow member 50 defines a lip portion that prevents ink from adhering the front face 35 of the ink jetting nozzle 30. The intersection 45 between outer diameter surface 50*b* and connection portion 50*d* provides a sharp point that provides for very little surface area to which an ink droplet can adhere.

FIG. 5E is the result of a two-step process by which the nozzle structure is obtained. In order to more fully explain the process involved for obtaining the nozzle structure shown in FIG. 5E, attention is directed to FIGS. 5A–5D that show the microprocessing steps.

In FIG. 5A, a (100) or other suitable orientated single crystal wafer 30, preferably made of silicon, is provided having a throughhole 40 having a predetermined dimension $d_0$. The silicon wafer 30 also includes the first plane 35 that is perpendicular to an axis 41 of the orifice or bore 40. The first plane 35 comprises a low index (100) crystallographic plane or other suitable fast etching plane. In FIG. 5B the (100) crystallographic plane 35 and the bore 40 are subjected to physical sputter erosion, e.g., a plurality of parallel radiating ion beams 60 that have a substantially perpendicular angle of incidence upon the (100) crystallographic plane 35. As a result of the application of the radiating ion beams to the (100) crystallographic plane 35 and the annular bore 40, a facet 55 begins to form in the region surrounding bore 40 at a predetermined angle Θ'. The angle Θ' at which facet 55 is created is obtained from a formula such as:

$$\Theta' = 90 - 178.2[NZ_1Z_2/(Z_1^{2/3} + Z_2^{2/3})E]^{1/3}$$

where N is an atomic density of the plane, $Z_1$ and $Z_2$ are atomic numbers of the silicon wafer or other substrate and incident ion beams, respectively, and E is the incident ion beam energy.

Figure 6:
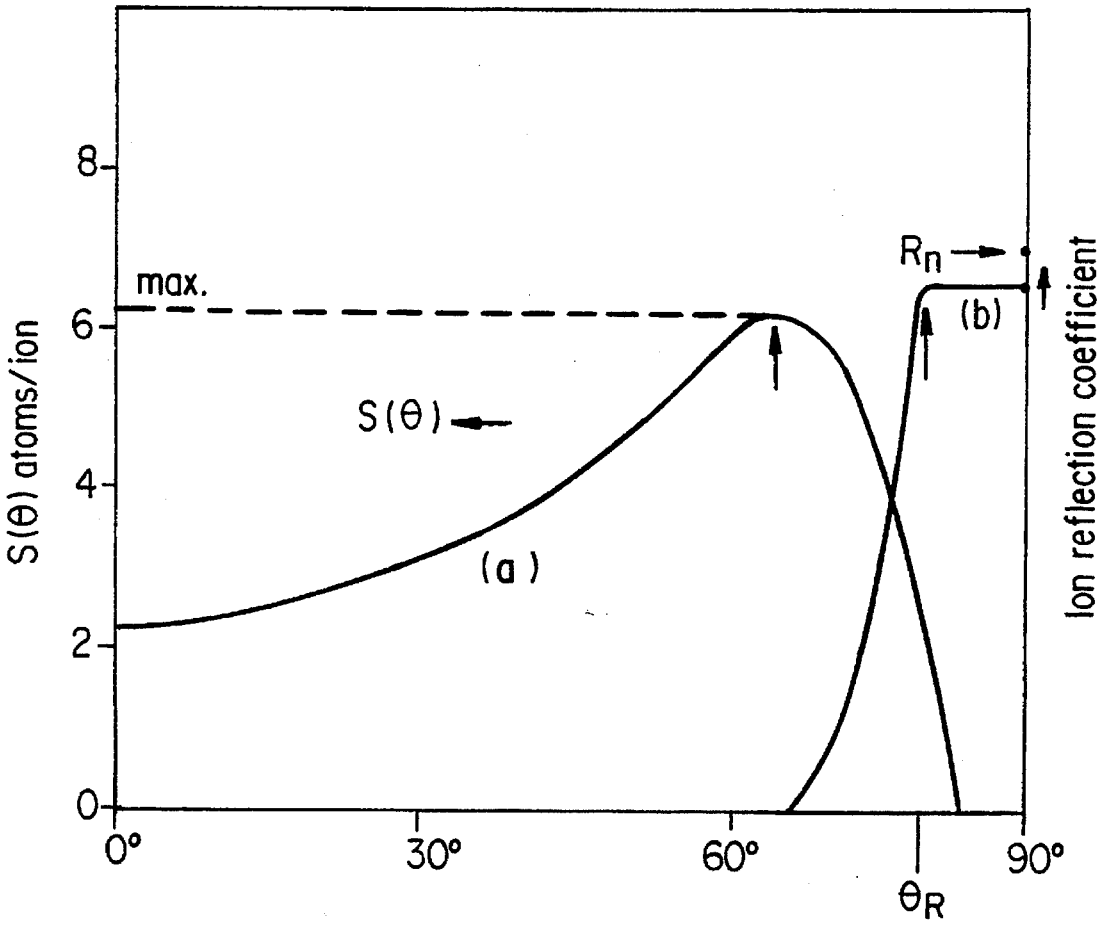
FIG. 6 shows a graph displaying the particular angle at which radiating ion beams will erode a facet to create high index surfaces.

FIG. 6 graphically portrays the general shape of the functional dependence of (a) the sputtering yield S with respect to Θ (the angle of incidence of the ion beam with respect to the surface normal); and (b) the ion reflection coefficient $R_n$ vs. Θ. Other formulas relating etch rate to surface topography can also be used to predict the angular dependence of the sputtering rate. In addition, different pairs of crystallographic planes can be used so long as the etching rate of the fast etching plane, for example, the (100) crystallographic plane etches between about 35–400 times faster than the slow etching plane, for example, the (111) crystallographic plane.

The ion beam radiation is just one of many types of physical sputter erosion that results in a nozzle having a countersunk hole 55' having a predetermined nozzle diameter as shown in FIG. 5C. Facet 55 in FIG. 5B is enlarged and eroded until plurality of (111) crystallographic planes 56 are created.

Starting with the countersunk orifice from FIG. 5B, the front face 35 and the countersunk orifice are equally exposed to a chemical etchant 62, for example an anisotropic etchant, shown in FIG. 5D. The anisotropic chemical etchant etches the (100) crystallographic plane 35 at a rate that is between 35 and 400 times higher than the rate at which the (111) crystallographic planes 56 are etched. Moreover, the creation of the facet 55 in FIG. 5B that eventually evolved into a plurality of slow etching or (111) crystallographic planes 56 shown in 5C acts to mask the plurality of high index crystallographic planes to render them substantially impervious to chemical etchants. The anisotropic chemical etchant is applied at a sufficient intensity and duration to erode or etch the fast etching or (100) crystallographic plane 35 thus leaving behind the hollow lip portion 50 as shown in FIG. 5E. In addition, the annular bore may be enlarged to a final desired dimension $d_f$.

The invention has been described with reference to the embodiments thereof which are intended to be illustrative rather than limiting. Various changes and modifications may be made without departing from the spirit and scope of the invention as defined in the following claims.

What is claimed is:

1. A method for microfabricating an ink jet nozzle including the steps of:

physical sputter erosion of a front face of the ink jet nozzle to expose (111) crystallographic planes around an orifice of the ink jet nozzle; and chemically etching a remainder of the front face of the ink jet nozzle at a rate between 35–400 times faster than the (111) crystallographic planes to create a lip surrounding the orifice.

2. A method for microfabricating a nozzle structure for use in ink jet printing devices, said nozzle structure comprising a semiconductor wafer defining a low index crystallographic plane and a bore having an axis substantially perpendicular to said low index crystallographic plane, the method comprising the steps of:

applying ion beams to said low index crystallographic plane, said ion beams having a substantially perpendicular angle of incidence upon said low index crystallographic plane;

eroding at an angle said low index crystallographic plane in a region surrounding said bore to define a plurality of high index crystallographic planes;

exposing said low index crystallographic plane and said plurality of high index crystallographic planes to an anisotropic chemical etchant; and chemically etching, using said anisotropic chemical etchant, said low index crystallographic plane at an etching rate greater than an etching rate of said plurality of high index crystallographic planes to create a nozzle structure surrounding the bore.

3. The method according to claim 2, further comprising the step of enlarging said bore.

4. The method of claim 2, wherein said eroding step comprises eroding said angle according to the formula $$\Theta'=90-178.2[NZ_1Z_2/(Z_1^{2/3}+Z_2^{2/3})E]^{1/3}$$

where N is an atomic density of the low index crystallographic plane; $Z_1$ and $Z_2$ are atomic numbers of the semiconductor wafer and incident ion beams, respectively, and E is an energy of the radiating ion beams.

5. The method according to claim 2, wherein said eroding step comprises eroding a (100) crystallographic plane and defining a plurality of (111) crystallographic planes.

6. The method according to claim 5, wherein said etching step includes etching the (100) crystallographic plane at a high etching rate and etching said (111) crystallographic plane at a low etching rate, and using a high to low etching rate ratio of approximately 35:1 to 400:1.

7. The method according to claim 2, wherein said eroding step masks said plurality of high index planes to render said plurality of high index crystallographic planes substantially impervious to anisotropic chemical etchants.

8. An ink jet nozzle structure produced in accordance with the method of claim 2.

9. A method for fabricating a nozzle structure, said nozzle structure comprising a wafer comprising a front surface defining a first plane, said first plane including at least one orifice, the method comprising the steps of:

developing a facet in a region surrounding said at least one orifice at an angle, said facet defining a plurality of second planes; and forming a lip portion on said wafer by etching said first plane at a first etching rate and said plurality of said second planes at a second etching rate that is lower than said first etching rate.

10. The method according to claim 9, wherein said developing step includes masking said plurality of second planes from said step of etching.

11. The method according to claim 9, further comprising the step of enlarging said orifice.

12. The method of claim 9, wherein said developing step comprises radiating ion beams at said angle according to a relationship.

13. The method according to claim 9, wherein said developing step comprises eroding a (100) crystallographic plane and defining a plurality of (111) crystallographic planes.

14. The method according to claim 13, wherein said forming step includes etching the (100) crystallographic plane at said first etching rate and etching said (111) crystallographic planes at said second etching rate, and using a first to second etching rate ratio of approximately 35:1 to 400:1.

15. An ink jet nozzle structure produced in accordance with the method of claim 9.

16. A method for microfabricating a nozzle structure for use in ink jet printing devices, said nozzle structure comprising a (100) silicon wafer comprising a front face defining a (100) crystallographic plane and bore, the method comprising the steps of:

creating a plurality of (111) crystallographic planes and masking said (111) crystallographic planes from chemical etchants by developing a facet in a region surrounding said bore at an angle;

forming a lip portion on said silicon wafer by chemically etching, using an anisotropic chemical etchant, said (100) crystallographic plane at a first etching rate, and said plurality of (111) crystallographic planes at a second etching rate lower than said first etching rate.

17. The method according to claim 16, further comprising the step of enlarging said bore to a dimension.

18. The method of claim 16, wherein said creating step comprises radiating ion beams at said angle according to the formula $$\Theta'=90-178.2[NZ_1Z_2/(Z_1^{2/3}+Z_2^{2/3})E]^{1/3}$$

where N is an atomic density of the (100) crystallographic plane; $Z_1$ and $Z_2$ are atomic numbers of the silicon wafer and incident radiating ion beams, respectively, and E is an energy of the radiating ion beams.

19. The method according to claim 16, wherein said forming step includes using a first etching rate approximately 35–400 times higher than the second etching rate.

20. An ink jet nozzle structure produced in accordance with the method of claim 16.

21. A one-piece ink jet nozzle for use in printing devices comprising:

a (100) silicon wafer having a surface;

at least one through opening of a dimension oriented perpendicular to said surface; and an extension lip comprising a wall member of dimensions having an outer dimension surface and an inner dimension surface, said inner dimension surface having a corresponding first axial length and said outer dimension surface having a corresponding second axial length greater than said first axial length, and an angled connection portion comprising a geometrical section connecting said inner diameter surface and said outer diameter surface.

22. The ink jet nozzle of claim 21, wherein said geometrical section comprises one of a conical, pyramidal and an n-sided polygonal section.

23. The ink jet nozzle of claim 21, wherein said surface comprises a (100) crystallographic plane and said connection portion comprises at least one (111) crystallographic plane.

24. The ink jet nozzle of claim 21, wherein an intersection between said outer dimension surface and said connection portion defines an acute angle.

25. The ink jet nozzle of claim 21, wherein an inner dimension of said inner dimension surface matches said dimension of the through opening.

26. The ink jet nozzle of claim 21, further comprising an intersection between said inner dimension surface and said connection portion that defines an obtuse angle.

27. An ink jet nozzle comprising:

a body member having a surface;

at least one through opening of a perimeter oriented perpendicular to said surface; and an extension member comprising a wall member having dimensions and having an outer perimeter surface and an inner perimeter surface; said extension member being offset and aligned with said perimeter of said through opening, said inner perimeter surface having a first length and said outer perimeter surface having a second length different than said first length.

28. The ink jet nozzle of claim 27, wherein said body member surface comprises a (100) crystallographic plane.

29. The ink jet nozzle of claim 27, wherein said second length is greater than said first length.

30. The ink jet nozzle of claim 27, further comprising an angled connection portion connecting said inner perimeter surface and said outer perimeter surface.

31. The ink jet nozzle of claim 30, wherein said angled connection portion comprises one of a pyramidal, an n-sided polygon and a conical section.

32. The ink jet nozzle of claim 30, wherein said angled connection portion comprises one of a slow etching plane and at least one (111) crystallographic plane.

33. The ink jet nozzle of claim 30, wherein an intersection between said outer perimeter surface and said connection portion defines an acute angle.

34. The ink jet nozzle of claim 30, further comprising an intersection between said inner perimeter surface and said connection portion that defines an obtuse angle.

* * * * *